US006538554B1

(12) United States Patent
Berger, II et al.

(10) Patent No.: US 6,538,554 B1
(45) **Date of Patent: *Mar. 25, 2003**

(54) RESISTORS FORMED OF ALUMINUM-TITANIUM ALLOYS

(76) Inventors: Robert E. Berger, II, 1097 Glendale Dr., Batavia, OH (US) 45103; Binod Kumar, 8470 Koster La., Washington Township, Dayton, OH (US) 45458-2768

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/061,918

(22) Filed: Apr. 17, 1998

Related U.S. Application Data

(60) Provisional application No. 60/044,670, filed on Apr. 18, 1997.

(51) Int. Cl.[7] ..... H01C 1/08

(52) U.S. Cl. ..... 338/59; 338/42; 338/319; 29/610.1

(58) Field of Search ..... 338/59, 42, 58, 338/319, 284, 283; 29/610.1

(56) References Cited

U.S. PATENT DOCUMENTS

| | | | | |
|---|---|---|---|---|
| 4,055,416 A | | 10/1977 | Oldrieve et al. | |
| 4,367,083 A | | 1/1983 | Gaul | |
| 4,602,192 A | | 7/1986 | Nomura et al. | |
| 4,851,192 A | * | 7/1989 | Baba et al. | 420/528 |
| 4,934,193 A | | 6/1990 | Hayata | |
| 5,157,373 A | | 10/1992 | Bertram et al. | |
| 5,286,446 A | | 2/1994 | McGarry | |
| 5,302,797 A | * | 4/1994 | Yasuyama et al. | 219/118 |
| 5,549,006 A | | 8/1996 | Kurtz | |
| 5,956,612 A | * | 9/1999 | Elliott et al. | 438/637 |

FOREIGN PATENT DOCUMENTS

| | | | | |
|---|---|---|---|---|
| EP | 0088599 | | 9/1983 | |
| EP | 0339676 | | 11/1989 | |
| EP | 0 530 560 A1 | * | 8/1992 | C22C/1/04 |
| EP | 0530560 | | 3/1993 | |
| FR | 2458597 | | 1/1981 | |

OTHER PUBLICATIONS

International Search Report for PCT/US98/07794 dated Oct. 5, 1998.

* cited by examiner

*Primary Examiner*—Elvin Enad
*Assistant Examiner*—Kyung S. Lee
(74) *Attorney, Agent, or Firm*—Dinsmore & Shohl LLP

(57) ABSTRACT

Resistors for use in electrical circuits are formed of an alloy comprising from about 50 to about 95 mol percent aluminum, from about 5 to about 50 mol percent titanium and up to about 15 mol percent of at least one additional metal or a combination of two or more additional metals.

30 Claims, 2 Drawing Sheets

RESISTORS FORMED OF ALUMINUM-TITANIUM ALLOYS

The present invention claims benefit of U.S. provisional application 60/044,670, filed Apr. 18, 1997.

FIELD OF THE INVENTION

The present invention relates to resistors adapted for use in electrical circuits and formed of aluminum-titanium alloys.

BACKGROUND OF THE INVENTION

Heavy duty power resistors are commonly employed in electrical circuits to control electrical current flow by converting electrical energy to heat, which may then be dissipated into the surrounding environment. Normally, resistors rated at 300 watts and above are considered power resistors. Typically, power resistors have been made from nickel-chromium alloys (NiChromes), copper-nickel alloys (Cu—Ni) or stainless steel alloys, with FeCrAl, 304 and 430 being the most common stainless steel types. Stainless steel is often modified with additional metals to improve its electrical characteristics, for example, resistivity and changes in resistivity levels over an operating temperature range. While all of these materials may be used in high temperature applications, i.e. up to about 1000° C., they all have one or more shortcomings which compromise their use.

For example, the nickel-chromium alloys commonly referred to NiChrome materials are expensive and heavy, both of which factors limit their use in a wide range of applications. On the other hand, the copper-nickel alloys are expensive and exhibit relatively low working temperatures and melting points. Additionally, the copper-nickel alloys are disadvantageous in that they are not readily available in sheet form. The stainless steel alloys also exhibit a relatively low resistivity and typically the resistivities of these alloys vary substantially over a temperature range, thereby rendering the alloys unsuitable for applications requiring precise resistivity requirements. Additionally, the type 430 stainless steel which is commonly employed is slightly magnetic and therefore unsuitable for low inductance applications. Various modified forms of stainless steel are also slightly magnetic and therefore unsuitable for low inductance applications. These modified stainless steel alloys are also typically more expensive and therefore not attractive for widespread use.

Accordingly, there is a continuing need for new resistors which would be suitable for widespread use, and particularly in heavy duty environments.

SUMMARY OF THE INVENTION

Accordingly, it is an object of the present invention to provide new resistors which may be advantageously employed in various applications owing to a desirable combination of properties. It is a further object of the invention to provide non-magnetic and lightweight resistors. It is a related object to provide such resistors which can be rated at 10 watts and above and which may be employed in heavy duty power environments. It is another object to provide resistors which may be employed in high temperature applications and in a temperature range of −40 to 1200° C.

These and additional objects are satisfied by the present invention which is directed to resistors adapted for use in electrical circuits. The resistors are formed of an alloy comprising from about 50 to 95 mol percent aluminum, from about 5 to about 50 mol percent titanium and up to about 15 mol percent of at least one additional metal or boron or a combination thereof. The resistors according to the present invention are strong, lightweight and non-magnetic. Additionally, the resistors according to the present invention exhibit nearly constant resistivity over a wide operating temperature range. The alloys from which the resistors are formed exhibit a good combination of ductility, material density and melting point to allow efficient manufacture of the resistors.

These and additional objects and advantages provided by the present invention will be more fully understood in view of the following detailed description.

DETAILED DESCRIPTION

Figure 1:
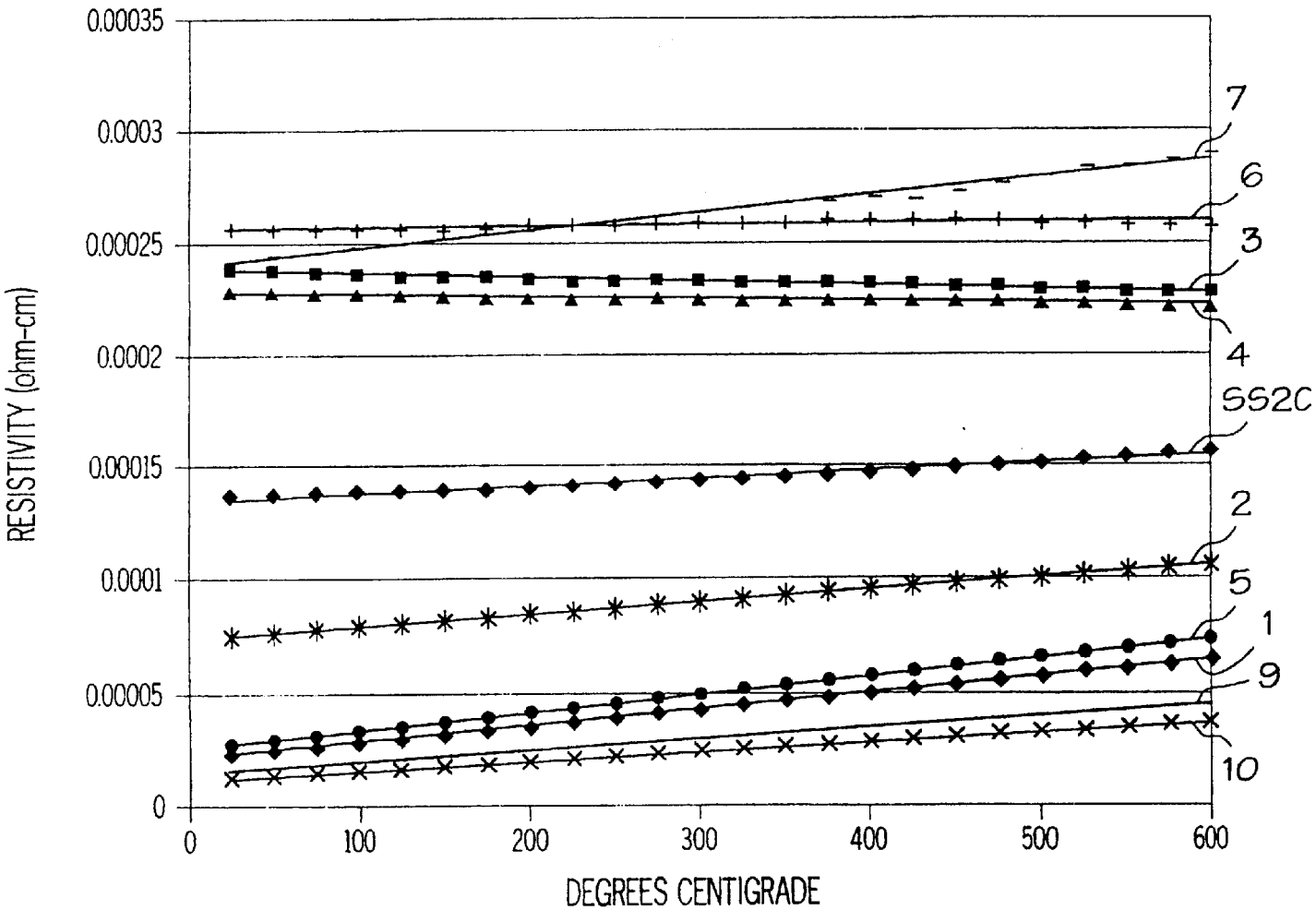
FIG. 1 sets forth resistivity measurements for various resistors according to the present invention over a temperature range of from about 25° C. to 600° C., as described in further detail herein.

The resistors according to the present invention are adapted for use in an electrical circuit and may be formed of any conventional resistor structure. As known in the art, resistors are employed to control current flow in an electrical circuit. Preferably, the resistor will include connectors for facilitating connection of the resistor into an electrical circuit in a conventional manner. The resistors of the present invention are suitable for use in a variety of applications, including heavy duty environments requiring resistors rated at 10 watts and above.

The resistors according to the present invention are formed of an alloy which comprises from about 50 to about 95 mol percent aluminum, from about 5 to about 50 mol percent titanium and up to about 15 mol percent of at least one additional metal or boron or a combination thereof. The present inventors have discovered that the aluminum-titanium alloys from which the present resistors are formed provide lightweight yet strong resistors. Additionally, the combination of ductility, resistivity, density and melting point exhibited by these alloys facilitates formation of the alloys into resistors of desired shapes and sizes, particularly when the alloys comprise at least one additional metal or boron or a combination thereof in an amount up to about 15 mol percent. Additionally, the alloys from which the present resistors are formed exhibit good corrosion resistance without disadvantageously effecting the resistivity properties.

In a preferred embodiment, the resistors according to the present invention are formed of an alloy comprising from about 60 to about 90 mol percent aluminum, or more preferably from about 60 to about 80 mol percent aluminum, from about 5 to about 30 mol percent titanium and from about 5 to about 15 mol percent of at least one additional metal or boron. In a further preferred embodiment, the resistors according to the present invention are formed from an alloy comprising from about 65 to about 70 mol percent aluminum, from about 20 to about 30 mol percent titanium and from about 5 to about 10 mol percent of at least one additional metal or boron. In one embodiment, the at least one additional metal comprises one or more transition metals of groups IB–VIIB or group VIII, although other metals or boron, may be employed, alone or in combination with one or more transition metals. In a preferred embodiment, the additional metal or boron is selected from the group consisting of copper, manganese, iron, chromium, vanadium, nickel, boron, and mixtures thereof. Generally, the alloys according to the invention exhibit densities in the range of from about 3.35 to about 4 g/cm$^3$. These alloys have melting points greater than 1200° C., which facilitate their use in high temperature environments.

The alloys from which the resistors of the present invention are formed may themselves be formed in accordance with conventional metal alloying techniques. Additionally, the alloys may be formed to resistors in accordance with techniques known in the art and particularly processing such as annealing, pressing, cutting, drilling and the like are facilitated with the alloys according to the present invention, particularly wherein at least one additional metal or boron is included in the aluminum-titanium alloy.

The resistors according to the present invention are demonstrated in further detail in the following example. In the example and throughout the present specification, parts and percentages are on a molar basis unless otherwise specified.

EXAMPLE

In this example, various aluminum-titanium alloys are formed and subjected to measurement of Vickers hardness according to ASTM-E92 using a load of 200 gf. The approximate molar composition and hardness of each alloy is set forth in Table 1. The hardness value for each allow is presented as an average of six measured values.

TABLE 1

| Alloy No. | Molar Composition | Average Vickers Hardness |
|---|---|---|
| 1 | $Al_{0.75}Ti_{0.25}$ | 446.4 |
| 2 | $Al_{0.63}Cu_{0.12}Ti_{0.25}$ | 242.6 |
| 3 | $Al_{0.67}Mn_{0.08}Ti_{0.25}$ | 263.5 |
| 4 | $Al_{0.67}Fe_{0.08}Ti_{0.25}$ | 289.6 |
| 5 | $Al_{0.68}B_{0.07}Ti_{0.25}$ | 479.8 |
| 6 | $Al_{0.67}Cr_{0.08}Ti_{0.25}$ | 257.0 |
| 7 | $Al_{0.67}V_{0.0.8}Ti_{0.25}$ | 396.2 |
| 8 | $Al_{0.67}Ni_{0.08}Ti_{0.25}$ | 371.4 |
| 9 | $Al_{0.79}Ni_{0.14}Ti_{0.07}$ | 352.1 |
| 10 | $Al_{0.90}Ti_{0.10}$ | 75.0 |

The alloys were formed as resistors, inserted into an electrical circuit and subjected to measurement of resistivity over a temperature range of from ambient to about 600° C. according to the four probe technique known in the art. The area and length of each resistor sample subjected to measurement is set forth in Table 2, and the results of the resistivity measurements are set forth in the FIG. 1. FIG. 1 also sets forth the resistivity measurements of a standard resistor formed of stainless steel SS2C.

TABLE 2

| Alloy No. | Sample Area | Sample Length |
|---|---|---|
| 1 | 0.423 cm$^2$ | 1.435 cm |
| 2 | 0.429 cm$^2$ | 1.184 cm |
| 3 | 0.413 cm$^2$ | 1.682 cm |
| 4 | 0.4269 cm$^2$ | 1.518 cm |
| 5 | 0.516 cm$^2$ | 2.01 cm |
| 6 | 0.567 cm$^2$ | 1.295 cm |
| 7 | 0.459 cm$^2$ | .696 cm |
| 8 | — | — |
| 9 | 0.342 cm$^2$ | 1.58 cm |
| 10 | 0.42 cm$^2$ | 1.918 cm |

Figure 2:
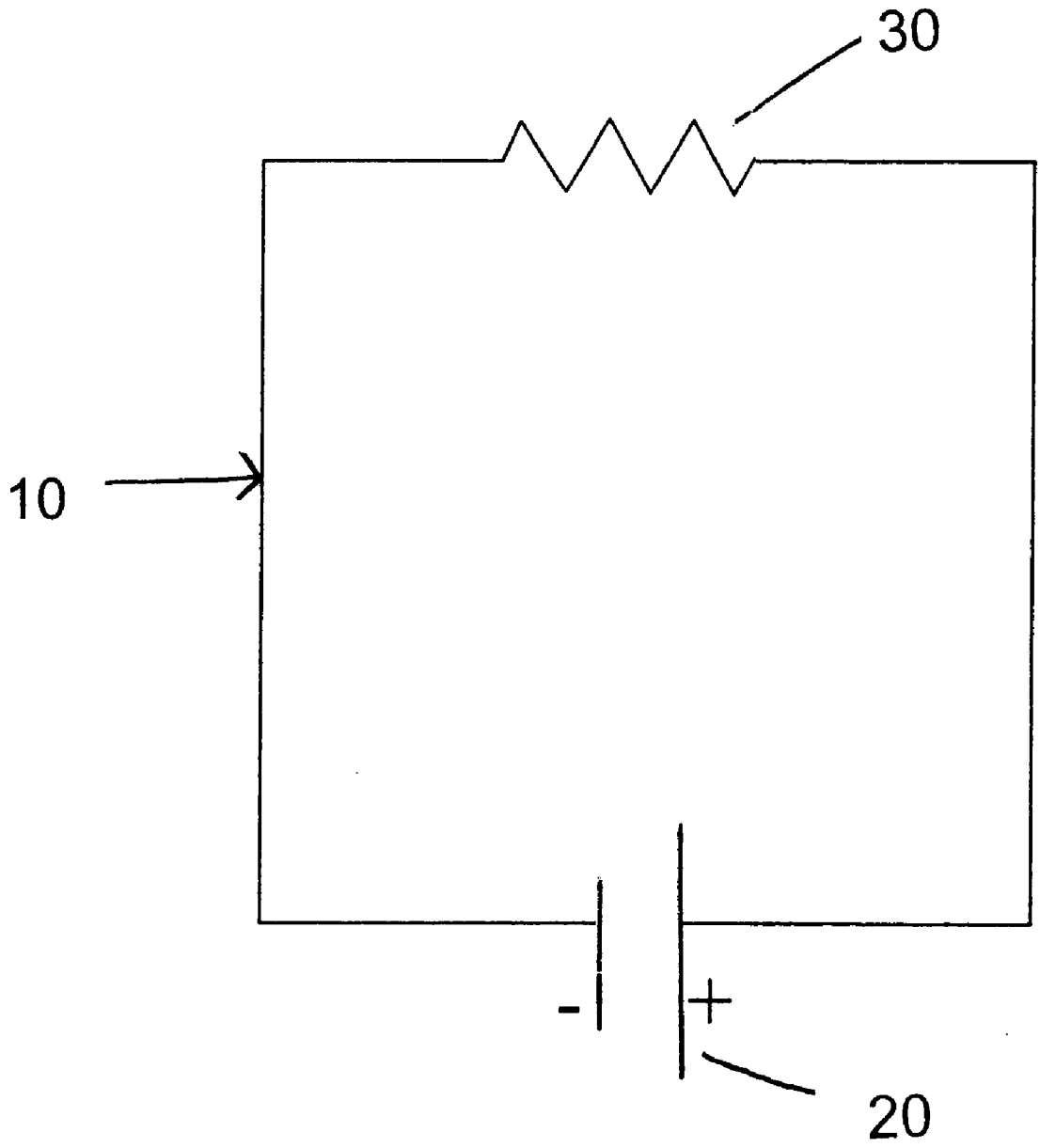
FIG. 2 is a schematic illustration of an electrical circuit according to the present invention.

The results set forth in FIG. 1 demonstrate that resistors according to the present invention generally exhibit consistent resistivity over wide temperature ranges and at a variety of levels, thereby demonstrating that the resistors according to the present invention are suitable for use in a variety of applications, including precision applications wherein significant variations in resistivity are to be avoided. Preferably, the resistivities according to the invention vary by not more than about 50%, more preferably by not more than about 30%, and even more preferably by not more than about 10%, over a temperature range of from about 25° C. to about 600° C. Additionally, the non-magnetic, lightweight, corrosion resistance and strength characteristics of the resistors according to the present invention contribute to their advantageous use in a variety of applications. In an alternative embodiment as shown in FIG. 2, an electrical circuit 10 includes a current source 20, for example a battery, and at least one resistor 30 formed of an alloy comprising from about 50 to about 95 mol percent aluminum, from about 5 to about 50 mol percent titanium and up to about 15 mol percent of at least one additional metal or boron.

The specific embodiments and examples set forth herein are provided to illustrate various embodiments of the invention and are not intended to be limiting thereof. Additional embodiments within the scope of the present claims will be apparent to one of ordinary skill in the art.

What is claimed is:

1. An electrical resistor formed of an alloy comprising from about 50 to about 95 mol percent aluminum, from about 5 to about 50 mol percent titanium, and from about 5 to about 15 mol percent of at least one additional metal or boron, the resistor including electrical circuit connectors.

2. A resistor as defined by claim 1, formed of an alloy comprising from about 60 to about 80 mol percent aluminum, from about 5 to about 30 mol percent titanium, and from about 5 to about 15 mol percent of at least one additional metal or boron.

3. A resistor as defined by claim 1, wherein the additional metal comprises a transition metal.

4. A resistor as defined by claim 1, formed of an alloy comprising from about 65 to about 70 mol percent aluminum, from about 20 to about 30 mol percent titanium, and from about 5 to about 10 mol percent of at least one additional metal or boron.

5. A resistor as defined by claim 1, wherein the additional metal is selected from the group consisting of copper, manganese, iron, chromium, vanadium, nickel, and mixtures thereof.

6. A resistor as defined by claim 1, formed of an alloy consisting essentially of aluminum, titanium and an additional metal or boron selected from the group consisting of copper, manganese, iron, chromium, vanadium, nickel, boron, and mixtures thereof.

7. A resistor as defined by claim 1, formed of a material of an approximate molar composition selected from the group consisting of $Al_{0.63}Cu_{0.12}Ti_{0.25}$, $Al_{0.67}Mn_{0.08}Ti_{0.25}$, $Al_{0.67}Fe_{0.08}Ti_{0.25}$, $Al_{0.68}B_{0.07}Ti_{0.25}$, $Al_{0.67}Cr_{0.08}Ti_{0.25}$, $Al_{0.67}V_{0.08}Ti_{0.25}$, $Al_{0.67}Ni_{0.08}Ti_{0.25}$, and $Al_{0.79}Ni_{0.14}Ti_{0.07}$.

8. A resistor as defined by claim 1, wherein the resistor is operable in an electrical circuit over a temperature range of from ambient up to about 600° C.

9. A resistor as defined by claim 1, formed of an alloy comprising from about 60 to about 90 mol percent aluminum, from about 5 to about 30 mol percent titanium and from about 5 to about 15 mol percent of at least one additional metal or boron.

10. An electrical circuit, comprising a current source and at least one resistor formed of an alloy comprising from about 50 to about 95 mol percent aluminum, from about 5 to about 50 mol percent titanium and from about 5 to about 15 mol percent of at least one additional metal or boron.

11. An electrical circuit as defined by claim 10, wherein the resistor is formed of an alloy comprising from about 60 to about 80 mol percent aluminum, from about 5 to about 30 mol percent titanium and from about 5 to about 15 mol percent of at least one additional metal or boron.

12. An electrical circuit as defined by claim 10, wherein the additional metal is selected from the group consisting of copper, manganese, iron, chromium, vanadium, nickel, and mixtures thereof.

13. A method of controlling current flow in an electrical circuit, comprising including in the electrical circuit a resistor formed of an alloy comprising from about 50 to about 95 mol percent aluminum, from about 5 to about 50 mol percent titanium and from about 5 to about 15 mol percent of at least one additional metal or boron.

14. An electrical resistor formed of an alloy comprising from 50 to 95 mol percent aluminum, from 5 to 50 mol percent titanium, and from 5 to 15 mol percent of at least one additional metal or boron, the resistor including electrical circuit connectors.

15. A resistor as defined by claim 14, formed of an alloy comprising from 60 to 80 mol percent aluminum, from 5 to 30 mol percent titanium, and from 5 to 15 mol percent of at least one additional metal or boron.

16. A resistor as defined by claim 14, formed of an alloy comprising from 65 to 70 mol percent aluminum, from 20 to 30 mol percent titanium, and from 5 to 10 mol percent of at least one additional metal or boron.

17. A resistor as defined by claim 14, formed of a material of the molar composition $Al_{0.63}Cu_{0.12}Ti_{0.25}$.

18. A resistor as defined by claim 14, formed of a material of the molar composition $Al_{0.67}Mn_{0.08}Ti_{0.25}$.

19. A resistor as defined by claim 14, formed of a material of the molar composition $Al_{0.67}Mn_{0.08}Ti_{0.25}$.

20. A resistor as defined by claim 14, formed of a material of the molar composition $Al_{0.68}B_{0.07}Ti_{0.25}$.

21. A resistor as defined by claim 14, formed of a material of the molar composition $Al_{0.67}Cr_{0.08}Ti_{0.25}$.

22. A resistor as defined by claim 14, formed of a material of the molar composition $Al_{0.67}V_{0.08}Ti_{0.25}$.

23. A resistor as defined by claim 14, formed of a material of the molar composition $Al_{0.67}Ni_{0.08}Ti_{0.25}$.

24. A resistor as defined by claim 14, formed of a material of the molar composition $Al_{0.79}Ni_{0.14}Ti_{0.07}$.

25. A resistor as defined by claim 14, formed of an alloy comprising from 60 to 90 mol percent aluminum, from 5 to 30 mol percent titanium and from 5 to 15 mol percent of at least one additional metal or boron.

26. An electrical circuit, comprising a current source and at least one resistor formed of an alloy comprising from 50 to 95 mol percent aluminum, from 5 to 50 mol percent titanium and from 5 to 15 mol percent of at least one additional metal or boron.

27. An electrical circuit as defined by claim 21 wherein the resistor is formed of an alloy comprising from 60 to 80 mol percent aluminum, from 5 to 30 mol percent titanium and from 5 to 15 mol percent of at least one additional metal or boron.

28. A method of controlling current flow in an electrical circuit comprising including in the electrical circuit a resistor formed of an alloy comprising from 50 to 95 mol percent aluminum, from 5 to 50 mol percent titanium and from 5 to 15 mol percent of at least one additional metal or boron.

29. An electrical resistor formed of an alloy comprising from about 50 to about 95 mol percent aluminum, from about 5 to about 50 mol percent titanium, and at least one additional metal or boron, wherein the additional metal is selected from the group consisting of copper, manganese, iron, chromium, vanadium, nickel, and mixtures thereof, and wherein the additional metal or boron is included in an amount up to about 15 mol percent, the resistor including electrical circuit connectors.

30. An electrical circuit comprising a current source and at least one resistor formed of an alloy comprising from about 50 to about 95 mol percent aluminum, from about 5 to about 50 mol percent titanium and at least one additional metal or boron, wherein the additional metal is selected from the group consisting of copper, manganese, iron, chromium, vanadium, nickel, and mixtures thereof, and wherein the additional metal or boron is included in an amount up to about 15 mol percent.

* * * * *

UNITED STATES PATENT AND TRADEMARK OFFICE

CERTIFICATE OF CORRECTION

PATENT NO. : 6,538,554 B1
DATED : March 25, 2003
INVENTOR(S) : Binod Kumar et al.

It is certified that error appears in the above-identified patent and that said Letters Patent is hereby corrected as shown below:

Column 5,
Line 36, change "$Al_{0.67}Mn_{0.08}Ti_{0.25}$" to -- $Al_{0.67}Fe_{0.08}Ti_{0.25}$ --.

Column 6,
Line 14, change "claim 21" to -- claim 26 --.

Signed and Sealed this

Twelfth Day of August, 2003

JAMES E. ROGAN
*Director of the United States Patent and Trademark Office*